United States Patent [19]

Wilkinson

[11] Patent Number: 4,662,173

[45] Date of Patent: May 5, 1987

[54] EXHAUST MANIFOLD FOR OPPOSED CYLINDER ENGINES

[75] Inventor: Ronald E. Wilkinson, Mobile, Ala.

[73] Assignee: Teledyne Industries, Inc., Los Angeles, Calif.

[21] Appl. No.: 728,251

[22] Filed: Apr. 29, 1985

[51] Int. Cl.[4] ..... F02B 27/02; F01N 7/00

[52] U.S. Cl. ..... 60/313; 60/322; 60/323

[58] Field of Search ..... 60/313, 312, 322, 323

[56] References Cited

U.S. PATENT DOCUMENTS

| | | | |
|---|---|---|---|
| 2,841,951 | 7/1958 | Whitcomb | 60/313 |
| 3,864,909 | 2/1975 | Kern | 60/282 |
| 3,940,927 | 3/1976 | Maurhoff | 60/322 |
| 4,103,487 | 8/1978 | Yamazaki | 60/322 |
| 4,197,704 | 4/1980 | Date | 60/313 |
| 4,341,186 | 7/1982 | Mayr et al. . | |
| 4,475,341 | 10/1984 | Inoue | 60/322 |

FOREIGN PATENT DOCUMENTS

| | | | |
|---|---|---|---|
| 592950 | 10/1947 | United Kingdom | 60/322 |

*Primary Examiner*—Douglas Hart

*Attorney, Agent, or Firm*—Gifford, Groh, VanOphem, Sheridan, Sprinkle and Dolgorukov

[57] ABSTRACT

An exhaust manifold for multi-cylinder, opposed piston engines includes a collector, a plurality of conduits, each connecting an exhaust port from a cylinder to the collector and each conduit includes a thermal expansion joint to permit differential thermal expansion between the engine body and the substantially hotter exhaust conduit and thus to avoid undesirable stresses in the conduits. Preferably, the expansion joint is formed by overlapping portions of conduit sections which include axial as well as radial clearances therebetween for thermal expansion. In the event that the engine is to be turbocharged, the manifold can be covered with a thermal blanket to prevent heat losses from the exhaust system. In such a case, the expansion joint includes a resilient seal member between the overlapping conduit portions which seals the conduit sections to each other despite substantially similar thermal growth in each of the insulated blanketed conduit sections.

12 Claims, 5 Drawing Figures

EXHAUST MANIFOLD FOR OPPOSED CYLINDER ENGINES

BACKGROUND OF THE INVENTION

I. Field of the Present Invention

The present invention relates generally to exhaust manifolds for internal combustion engines, and more particularly to an exhaust manifold for scavenging exhaust gases from opposed cylinders of an opposed cylinder engine.

II. Description of the Prior Art

It has been found that opposed cylinder internal combustion engines are advantageous because forces resulting from combustion are directed along opposing vectors, thereby regulating vibration and counter-balancing forces. Such considerations are especially important for engines used in aircraft. In previously known opposed four cylinder engines, it has been known to connect two exhaust pipes extending from the exhaust ports of a pair of opposed cylinders together so that opposed discharges from one exhaust port can be used to scavenge air from the other pipe and to minimize the effect of the rarefaction wave which is generated at the outlet of each exhaust pipe. In six cylinder engines the three adjacent exhaust pipes were normally connected on each side into a common single duct. Such pipes are typically rigid structures for strength and stability, and thus can be stressed when they expand as they heat up during engine operation.

Moreover, it can be appreciated that while both the engine and the exhaust ducts are subject to thermal expansion, the engine temperature can be maintained at approximately 250° F. while the exhaust ducts are subjected to substantially higher temperatures, typically around 1500° F. As a result, the exhaust ducts typically undergo greater internal expansion than the engine. This difference can cause undesirable stresses in the pipes which, since they are joined together, can cause fracturing or other undesirable damage to the exhaust system and the engine. Moreover, in previously known opposed four cylinder engines, only two pipes are joined together so that discharged pulses of exhaust from adjacent cylinders do not create additional rarefaction wave problems in the first pair of cylinders. In the previously known opposed six cylinder engines, only the three adjacent pipes are joined together to avoid additional rarefaction wave problems.

In addition, in turbo charged engines, it is advantageous to reduce exhaust gas heat loss. The problem of heat loss can be especially pronounced in high altitudes. As a result, it would be advantageous to avoid losses by applying an insulation cover over the exhaust manifold. Unfortunately, retention of heat within the exhaust manifold aggravates the differential thermal expansion between the exhaust ducts and the engine body.

SUMMARY OF THE PRESENT INVENTION

The present invention overcomes the above mentioned disadvantages by providing an exhaust manifold for opposed cylinder internal combustion engines which includes improved means for compensating for differential thermal expansion between the exhaust ducts and the engine body. In addition, each of the exhaust ducts are connected to a common collector or plenum chamber without adversely affecting the scavenging section of each individual duct. In addition, the exhaust manifold of the present invention can be used to aid in the scavenging of exhaust gases from the cylinders to which they are attached.

In general, the present invention comprises an exhaust conduit means for directing a flow of the exhaust gases away from each cylinder toward a common collector. Each exhaust conduit means comprises at least two conduit sections which are connected together by a means for compensating for the differential thermal expansion between each conduit section as well as the exhaust conduit means and the engine body. When the exhaust conduit means is exposed to ambient conditions, the compensating means can comprise overlapping portions of a conduit section to form an expansion joint. On the other hand, if the exhaust conduit means is covered by a thermal blanket to retain heat, a seal ring is engaged between the overlapping portions of the conduit sections. Preferably, the seal member is a metallic ring having substantially c-shaped cross section.

Moreover, when the engine includes a plurality of pairs of opposed cylinders, the plenum chamber of the collector is bifurcated by a partition wall so that only the exhaust conduit means on one side of an engine are in direct fluid communication with each other. Such a construction further reduces interference of the scavenging of exhaust gases from cylinders.

Thus the present invention provides an exhaust manifold which adjusts for thermal expansion of the materials from which the manifold is formed. Moreover, the invention permits a plurality of pairs of opposed cylinder exhaust ports to be connected together in a manner which positively aids the scavenging of the exhaust from the cylinders. Moreover, the manifold is operable under conditions in which heat loss from the exhaust ducts is desirable or in which conservation of the heat within the exhaust ducts is desired for operation of a turbocharger.

BRIEF DESCRIPTION OF THE DRAWING

The present invention will be more clearly understood by reference to the following detailed description of a preferred embodiment of the present invention when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
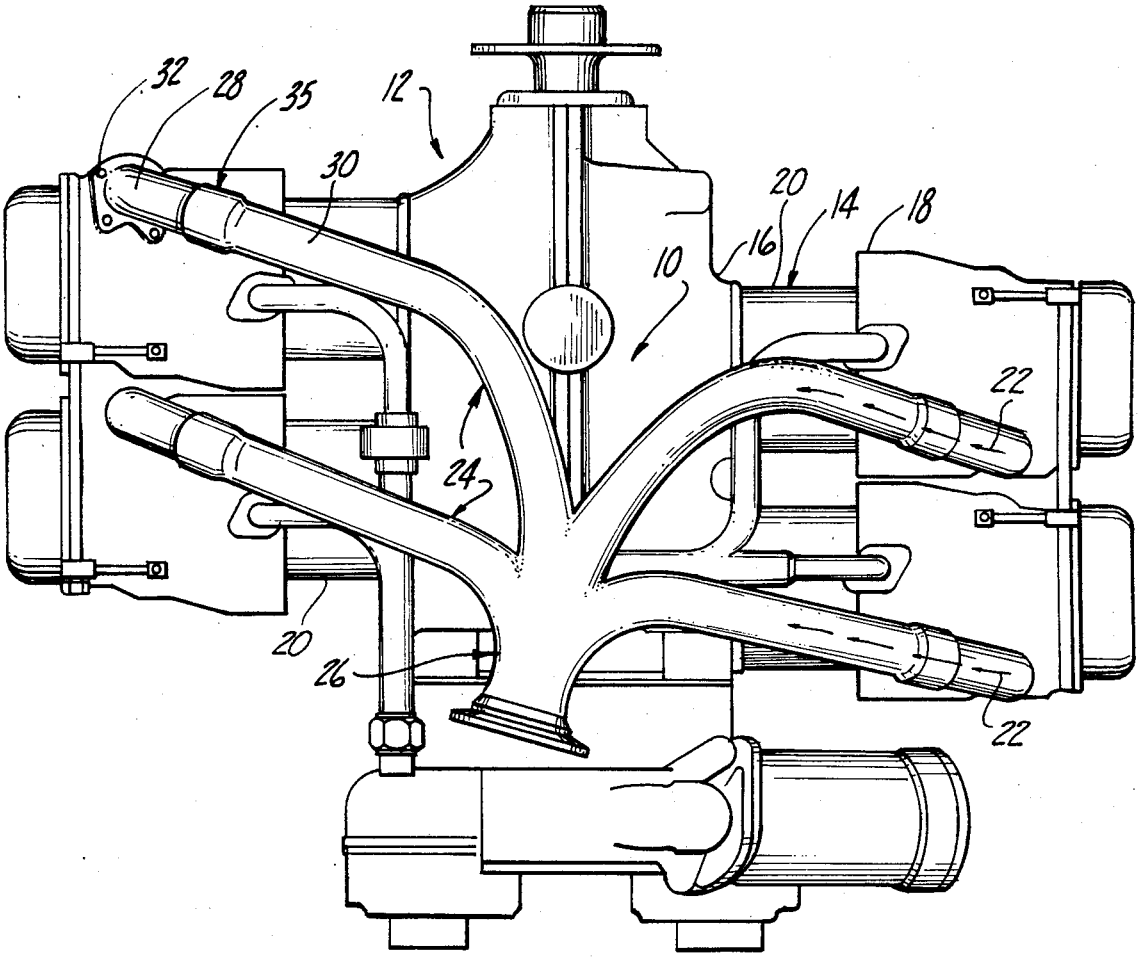
FIG. 1 is a bottom plan view of a four cylinder, opposed piston engine including an exhaust manifold according to the present invention.

Referring first to FIG. 1, a manifold 10 according to the present invention is thereshown applied to a four cylinder, opposed piston engine 12. The engine 12 comprises an engine body 14 which includes a block 16, and cylinder head portions 18 which together provide a plurality of cylinders 20. Each cylinder 20 communicates through an exhaust port as shown diagrammatically at 22 in FIG. 1 which is opened and closed by valve means (not shown) in a well known manner.

The manifold 10 comprises an exhaust conduit means 24 for directing the flow of exhaust gases from each port 22, and a collector body 26 which is attached to one end of each exhaust conduit means 24 in fluid communication therewith. Each exhaust conduit means 24 comprises a first conduit section 28 having one end adapted to be received in one end of a second conduit section 30. The other end of the conduit section 28 can include a flared end portion adapted to be engaged by a mounting flange 32 which secures the conduit 28 over the port 22 to the engine body 14 in a well known manner. The other end of the conduit section 30 is welded or otherwise connected in fluid communication with the collector housing 26.

Figure 3:
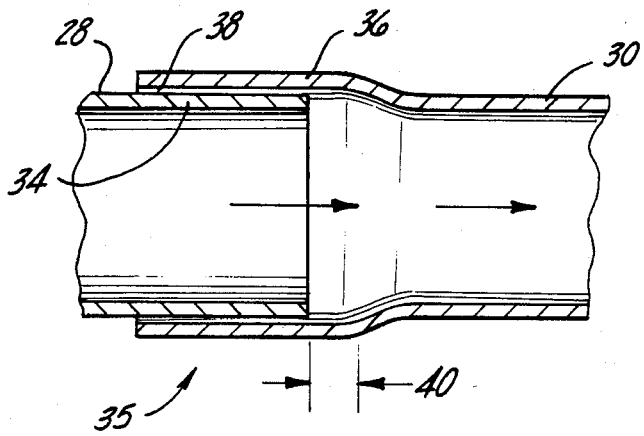
FIG. 3 is a sectional view taken substantially along the line 3—3 in FIG. 1.

As best shown in FIG. 3, the connection between the conduit sections 28 and 30 provides a means for compensating for thermal expansion of the exhaust conduit means 24 which is greater than the lateral expansion of the engine body 14. An end portion 34 of the conduit section 28 extends into an enlarged diameter end portion 36 of conduit section 30 so that the end portions 34 and 36 overlap to form an expansion joint 35. At room temperature, a diametrical clearance gap 38 between the periphery of the end portion 34 and the end portion 36 is provided between the conduit section ends. In addition, the expanded end portion 36 of conduit section 30 is slightly longer than the inserted end portion 34 of the conduit section 28 forming an axial gap 40 to permit the conduit section 28 to elongate within the conduit section 30 as the conduit sections heat up during engine operation without substantial variation in the length in the conduit means 24 from the exhaust port 22 to the collector body 26.

In addition, since the conduit section 28 is in more direct contact with the hot exhaust gases released from the cylinder, the conduit section 28 circumference expands while heated during engine operation to engage and seal against the periphery of the conduit end 36 of conduit section 30. Since conduit section 30 is exposed to the ambient air and more freely loses heat than the conduit section 34, a tight sealing engagement between the conduit section 28 and conduit section 30 in the expansion joint 35 prevents leakage of exhaust gases. In the preferred embodiment, the radial gap 38 is approximately in the range of 0.002 to 0.008 inch clearance before engine operation, although it is essentially 0 during engine operation. The axial gap 40 permitting extension of the conduit section 28 into the conduit section 30 is typically about 0.25 inches at room temperature and is substantially reduced during engine operation.

Figure 2:
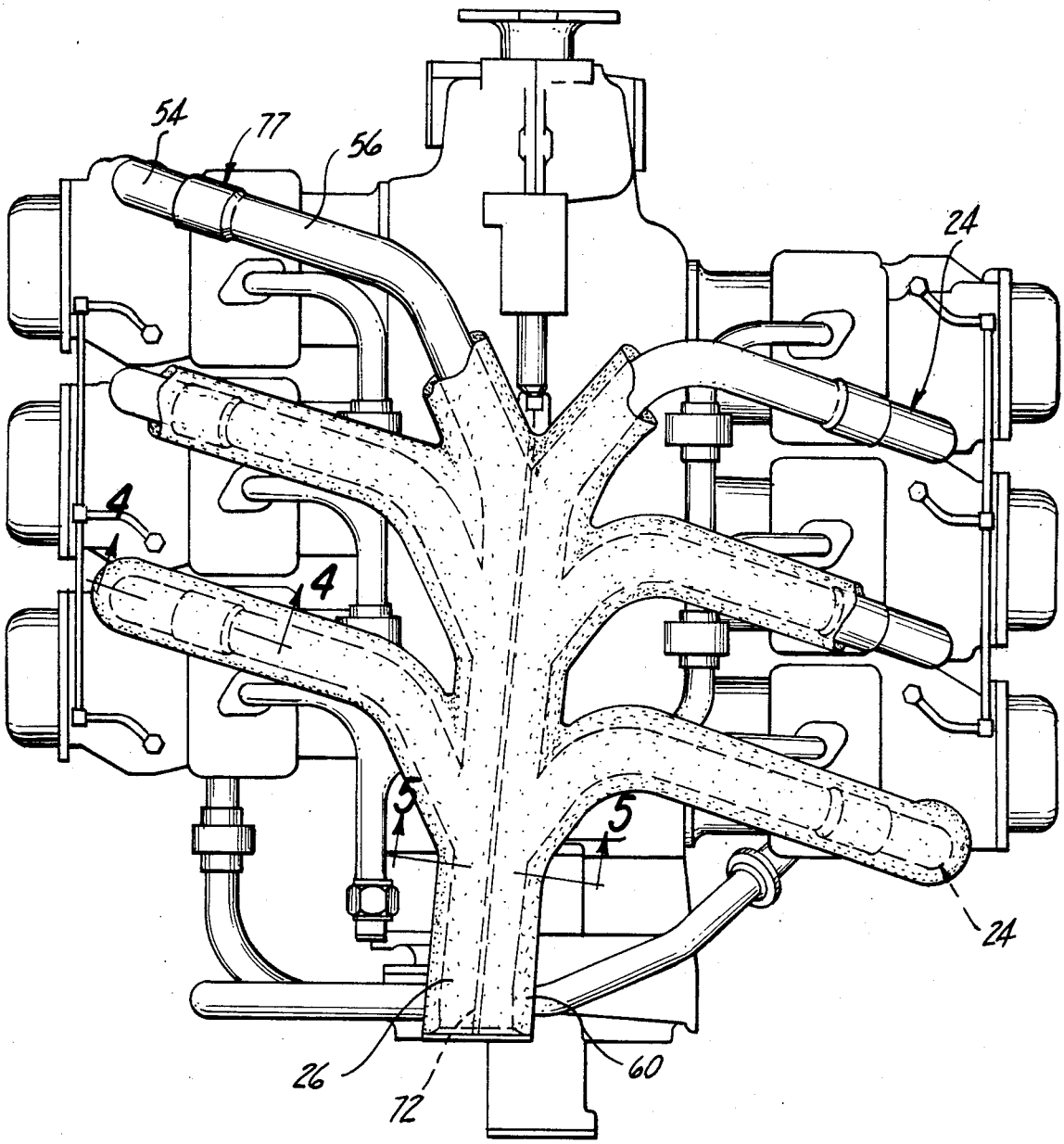
FIG. 2 is a bottom plan view of a six cylinder, opposed piston engine including a modified form of exhaust manifold according to the present invention.

Referring now to FIG. 2, a manifold 50 according to the present invention is thereshown secured to a six cylinder, opposed piston internal combustion engine body 52. In the same manner as discussed with reference to FIG. 1, the engine body 52 comprises the block and other head portions which form cylinders of the engine. Moreover, the construction of the exhaust ports and valve mechanism opening and closing the ports can be substantially the same as that used in the engine 12 shown in FIG. 1. However, it will be understood that several modifications have been made to manifold 50 which are not shown in the manifold 10 shown in FIG. 1.

While the manifold 50 includes a plurality of exhaust conduit means 24 connecting the ports 22 to a central connector body 26, each conduit means 24 includes a first conduit section 54 and a second conduit section 56 connected by a thermal compensation coupling means in the form of expansion joint 77. The difference between the conduit sections 54 and 28 and the conduit sections 56 and 30 are shown in greater detail in FIG. 4. Moreover, as shown in FIG. 2, the manifold 50 includes a thermal blanket in the form of an insulating layer 60 although portions of the blanket are shown cut away for the sake of clarity.

Figure 4:
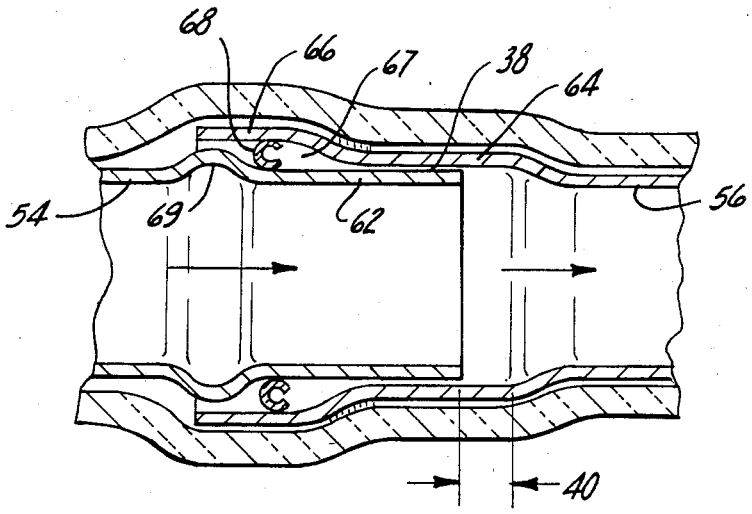
FIG. 4 is a sectional view taken substantially along the line 4—4 in FIG. 2.

As best shown in FIG. 4, an end 62 of the conduit section 54 is received within an end 64 of the conduit section 56. The end portions 62 and 64 overlap and typically include a radial gap 38 and axial gap 40 similar to those shown in FIG. 3. Moreover, the end portion 64 of conduit section 56 includes a radially expanded end portion 66 which increases the space between the conduit section 56 and the periphery of conduit section 54. The gap 67 between conduit portions 66 and the conduit portion 62 receives a resilient seal member 68 in the form of a metal ring having a substantially c-shaped cross section. The channel in the ring opens toward the reduced radial gap 38 between the conduit section 56 and the conduit section 54. In order to entrain the sealing member 68 within the gap 67 formed between the end portion 66 and end portion 62, conduit section 54 includes a projection 69 extending radially outward toward the end portion 66 of the conduit section 56 at a position spaced from the axial end of conduit section 54. Preferably, the projection 69 is in the form of a peripheral projection extending around the circumference of the entire conduit section 54. The axial length of the gap 67 allows elongation of the conduit section 54 into the conduit section 56 as previously discussed across the gap 40 without displacement of the sealing ring 68 from its operative position.

It can be appreciated that the thermal blanket 60 substantially reduces heat losses from both the conduit section 54 and the conduit section 56. As a result, radial thermal expansion of the conduit section 56 is substantially the same as radial thermal expansion of the conduit section 54. As a result, the gap 38 does not close completely during engine operation. Nevertheless, the seal member 68 serves to prevent the leakage of exhaust gases through the expansion joint 77 shown in FIG. 4.

Figure 5:
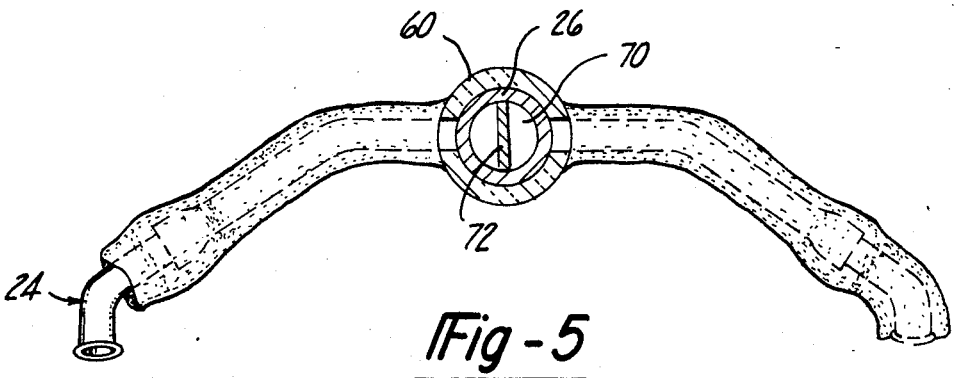
FIG. 5 is a sectional view taken substantially along the line 5—5 in FIG. 2.

Referring now to FIG. 5, it can be seen that the plenum chamber 70 of the collector body 26 is divided into two chamber portions by a partitioning wall 72. As a result, only the exhaust conduit means 24 on one side of the engine are in fluid communication with each other at the collector. Conversely, the exhaust conduit means 24 on the opposite side of the engine are coupled in direct fluid communication with only those exhaust conduit means 24 from the same side of the engine.

Having thus described the important structural features of the present invention, the operation of the manifold is easily explained. Of course, it is to be understood that each exhaust conduit means 24 has a predetermined length between its respective exhaust port 22 and its opening into the collector body 26. At that predetermined length, each exhaust conduit means 24 is tuned so that the pulse generated after the exhaust valve opens does not interfere with the scavenging of exhaust gases from other exhaust ports in the engine. Moreover, it will be recognized that pulses reflected from the open end of a conduit means 24 have a strong rarefaction which travels back to the exhaust port. Thus, each exhaust conduit means 24 of the present invention is pref-erably tuned to insure that the rarefaction wave does not arrive when it can interfere with release of exhaust gases from the port. Furthermore, in the preferred embodiment, the length is particularly determined so that a trough of the wave causes a low pressure condition at the port during the overlap period when both the exhaust valve and the intake valve are open. As a result, the low pressure causes a draft which forces air through the intake port and out the exhaust port to evacuate an additional amount of exhaust gases through the exhaust port.

Regardless of how the optimum length of each exhaust and conduit means 24 is determined, it will be understood that the expansion joints 35 and 77 of the present invention permit the ducts to adjust for thermal expansion of the materials without substantially departing from the optimum length required for the duct. Moreover, each of the expansion joints 35 and 77 provides a means for sealing the first conduit section to the second conduit section to prevent leakage of exhaust gases under all operating conditions. Moreover, when a partitioning wall 72 is utilized in the manner shown in FIG. 5, it will be understood that the discharge pulses from one side of the engine do not interfere with discharge pulses or exhaust scavenging from the opposite side of the engine.

Moreover, it will be understood that when conservation of heat in the exhaust manifold is desired, as when a turbocharge is to be used with the engine, the improved thermal expansion joint 77 permits the conduit means 24 to adjust for differential thermal expansion and prevents the seepage of exhaust gases therefrom. As a result, even when the engine is operated at high altitudes, where the pressure exteriorly of the conduit means 24 is substantially less than the pressure within the conduit means 24, seepage of exhaust gases can be avoided by the expansion joints in the manifold of the present invention.

Having thus described my invention, many modifications thereto will become apparent to those skilled in the art to which it pertains without departing from the scope and spirit of the present invention as defined in the appended claims.

What is claimed is:

1. An exhaust system for an opposed cylinder engine having an engine body having a first bank of at least two cylinders diametrically opposed from a second bank of at least two cylinders, said exhaust system comprising:

a first conduit member fixedly attached to each cylinder of said first and second banks for flow communication therebetween;

exhaust means for directing the flow of exhaust gasses from said opposed cylinder engine, said exhaust means comprising, a plenum having a longitudinal axis disposed along a vertical plane passing through a central axis of said engine, said plenum having a wall portion disposed along said longitudinal axis of said plenum, said wall portion forming a first chamber passage and a second chamber passage, each of said first and second chamber passage having an inlet portion, a first plurality of conduit portions extending from said inlet portion of said first chamber passage, each of said first plurality of conduit portions connected to a respective cylinder of said first bank for flow communication, each of said first plurality of conduit portions disposed in a parallel spaced apart relationship from an adjacent one of said first plurality of conduit portions, each of said first conduit portions connected to said inlet portion of said first chamber passage for scavenging exhaust gasses from said first bank, a second plurality of conduit portions extending from said inlet portion of said second chamber passage, each of said second plurality of conduit portions connected to a respective cylinder of said second bank for flow communication, each of said second plurality of conduit portions disposed in a parallel spaced apart relationship from an adjacent one of said second plurality of conduit portions, each of said second conduit portions connected to said inlet portion of said second chamber portion for scavenging exhaust gasses from said second bank, said inlet portions of said first and second chamber passages disposed on opposite sides of said wall portion, such that said wall portion deflects rarefaction waves accompanying said exhaust gasses flowing into said first and second chamber portions; and means for coupling said first conduit member to a respective conduit portion of each of said first and second plurality of conduit portions, said means for coupling compensating for the difference in thermal expansion between said first conduit member and said exhaust means.

2. The invention as defined in claim 1 wherein said coupling means comprises means for sealing against leakage between said first conduit member and said second plurality of conduit portions.

3. The invention as defined in claim 2 wherein said first conduit member includes one end portion dimensioned to be received in one end of each of said first and second plurality of conduit portions with a predetermined mean clearance therebetween, and wherein each said first conduit members and each of said first and second plurality of conduit portions is exposed to ambient conditions, whereby said one end portion of said first conduit member expands to seal against said one end of each of said first and second plurality of conduit portions when said first conduit members are heated during engine operation.

4. The invention as defined in claim 2 wherein each of said first and second plurality of conduit portions includes an expanded end portion having a greater diameter than the adjacent end portion of said first conduit member to receive said adjacent end portion therein, and further comprising a resilient seal member captured between said expanded end portion of each of said plurality of first and second conduit portions and said adjacent end portion of said first conduit member.

5. The invention as defined in claim 4 wherein said seal member comprises an annular ring having a substantially c-shaped cross section having a gap extending in a direction parallel with an axis of said first conduit member.

6. The invention as defined in claim 5 wherein said annular ring is made of metal.

7. The invention as defined in claim 4 wherein said adjacent end portion of said first conduit member includes a peripheral projection spaced from the axial end of said first conduit member and wherein said seal member is positioned between said projection and said axial end.

8. The invention as defined in claim 4 wherein conduit said exhaust conduit means is peripherally covered by a layer of insulation.

9. The invention as defined in claim 8 wherein said engine includes a turbocharger.

10. The invention as defined in claim 1 wherein said engine includes at least six cylinders.

11. The invention as defined in claim 1 wherein each said engine cylinder comprises an intake port, and wherein said engine includes means for closing and opening said intake port, means for opening and closing said exhaust port, and means for timing the opening and closing of said intake and exhaust ports so that the opening of the exhaust port overlaps with the opening of the intake port, and wherein the predetermined length of said exhaust means forms a wave guide adapted to transmit a low pressure trough of a rarefaction wave at the time of said overlap.

12. The invention as defined in claim 1 wherein said plenum chamber is integrally formed with said first and second plurality of conduit portions.

* * * * *

UNITED STATES PATENT AND TRADEMARK OFFICE

CERTIFICATE OF CORRECTION

PATENT NO. : 4,662,173

DATED : May 5, 1987

INVENTOR(S) : Ronald E. Wilkinson

It is certified that error appears in the above-identified patent and that said Letters Patent is hereby corrected as shown below:

Col. 6, line 66, delete "conduit";

Col. 6, line 67, delete "conduit".

Signed and Sealed this

Twenty-seventh Day of October, 1987

*Attest:*

DONALD J. QUIGG

*Attesting Officer*

*Commissioner of Patents and Trademarks*